United States Patent [19]

Jokel

[11] Patent Number: 4,573,285

[45] Date of Patent: Mar. 4, 1986

[54] WINDOW INTRUSION BARRIER

[76] Inventor: Isidore Jokel, 4201 Newport H, Deerfield Beach, Fla. 33441

[21] Appl. No.: 636,094

[22] Filed: Jul. 30, 1984

Related U.S. Application Data

[63] Continuation-in-part of Ser. No. 573,855, Jan. 25, 1984, Pat. No. 4,532,734.

[51] Int. Cl.[4] ..... E06B 3/68

[52] U.S. Cl. ..... 49/55; 49/57

[58] Field of Search ..... 49/55, 57

[56] References Cited

U.S. PATENT DOCUMENTS

| | | | |
|---|---|---|---|
| 953,197 | 3/1910 | Fox | 49/57 |
| 980,535 | 1/1911 | Kleinegger | 49/57 |
| 2,775,001 | 12/1956 | Baker | 49/57 X |
| 2,819,500 | 1/1958 | Saber | 49/55 X |
| 2,928,334 | 3/1960 | Van De Veire | 49/57 X |
| 3,160,927 | 12/1964 | Bueillo | 49/57 |
| 4,038,800 | 8/1977 | Daley, Jr. | 49/55 X |
| 4,226,049 | 10/1980 | Maust | 49/57 |

FOREIGN PATENT DOCUMENTS

| | | | |
|---|---|---|---|
| 565934 | 8/1975 | Switzerland | 49/55 |

*Primary Examiner*—Kenneth Downey
*Attorney, Agent, or Firm*—Norman B. Rainer

[57] ABSTRACT

A safeguard system is provided to prevent unauthorized entry through an open window of a casement in which said window is vertically positionable. The system involves a barrier apparatus comprised of two framed gridwork panels in horizontally spaced coplanar juxtaposition. The spacing between the frames is adjusted by a coupling pin which insertively engages matching apertures in an extension arm and a horizontal border of a frame. A locking device is provided to prevent vertical movement of the window away from engagement with the barrier device.

5 Claims, 5 Drawing Figures

WINDOW INTRUSION BARRIER

RELATED APPLICATIONS

This is a continuation-in-part application based upon application Ser. No. 573,855, filed 01/25/84, U.S. Pat. No. 4,532,734.

BACKGROUND OF THE INVENTION

This invention concerns apparatus for preventing unauthorized entrance of a person into a building, and more particularly concerns a barrier apparatus of adjustable dimensions which may be removably inserted into the framework of an open window of a building to prevent passage of a person through said open window.

In residential and industrial buildings, windows capable of opening and closing and having transparent panels serve to permit entrance of sunlight and passage of air, and function as emergency exits in case of fire. However, when the window is open, the security of the building is threatened because of the relative ease with which an intruder may enter through said open window.

Various devices have been disclosed for thwarting unauthorized entrance through an open window while still retaining most of the functionality of the window. Such devices, however, have not heretofore been entirely successful. For complete effectiveness, the barrier device should be capable of easy installation into and rapid removal from variously sized window casements while being non-removable by would-be intruders. The device should preferably be adjustable to fit windows of various sizes without need for modifying the window or casement. The barrier should furthermore provide minimal occlusion of the area it occupies while having sufficient strength to resist forceful breakage.

It is accordingly an object of this invention to enable a slideably positionable window to be opened to permit passage of air while preventing entrance of an intruder.

It is another object of the present invention to provide a barrier apparatus of adjustable size capable of facile insertion into the rectangular space of the casement of an opened, slideably positionable window, without necessitating structural modification of said casement or window.

It is a further object of this invention to provide barrier apparatus as in the foregoing object which can be easily removed by the user but not removable by a would-be intruder.

It is a still further object of this invention to provide a barrier apparatus of the aforesaid nature of rugged and durable construction which may be economically manufactured.

These objects and other objects and advantages of the invention will be apparent from the following description.

SUMMARY OF THE INVENTION

The above and other beneficial objects and advantages are accomplished in accordance with the present invention by an improved safeguard system which comprises a barrier apparatus of adjustable horizontal length adapted for insertion into a window casement below a window slideably positionable therein, and locking means for immobilizing the window with respect to its casement.

The barrier apparatus is comprised of two gridwork panels of substantially equal dimensions, each bordered by a rigid rectangular frame. The gridwork panels are preferably fabricated of metal such as steel in a configuration providing substantial strength, yet with adequate open space so as not to obscure vision or impede passage of air.

The panels are adapted to be placed in a horizontally spaced side-by-side coplanar juxtaposition, whereby the vertically disposed facing side borders of the frame are parallel, and upper and lower horizontally disposed borders of the frame are aligned in a straight path. One of the vertically disposed facing side borders is provided with guide apertures, and the facing side border of the opposite frame is provided with horizontally oriented mating posts adapted to insertively engage said guide apertures in a telescoping manner.

At least one of the horizontally disposed borders of one of the frames is provided with a first series of positioning apertures of uniform size. The corresponding upper or lower horizontally disposed border of the other frame is provided with an extension arm having a second series of positioning apertures adapted to align vertically with said first series of positioning apertures.

A coupling pin is provided for the purpose of penetrating a pair of aligned apertures in said first and second series of positioning apertures, thereby interengaging said extension arm with the horizontally disposed border of the opposite frame. A protective channel may be provided to fit over said coupling pin in a manner to prevent easy removal of said pin. In a preferred embodiment of the invention, both the upper and lower horizontally disposed borders are equipped with a first series of positioning apertures, an associated extension arm having a second series of positioning apertures, and a coupling pin.

In operation, the panels are held vertically upright with the lower horizontal borders of the frames resting upon the lower portion or sill of the casement. The panels are drawn apart while still telescopically interengaged until the extreme vertical side borders of the frames substantially contact the opposite vertical sides of the window casement. The coupling pin is inserted through mating apertures in an extension arm and associated horizontally disposed border of the opposite frame. The window is then drawn into substantial abutment with the upper horizontally disposed borders of the frames, and is immobilized by locking means interactive between the inside surface of the window frame and the casement.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
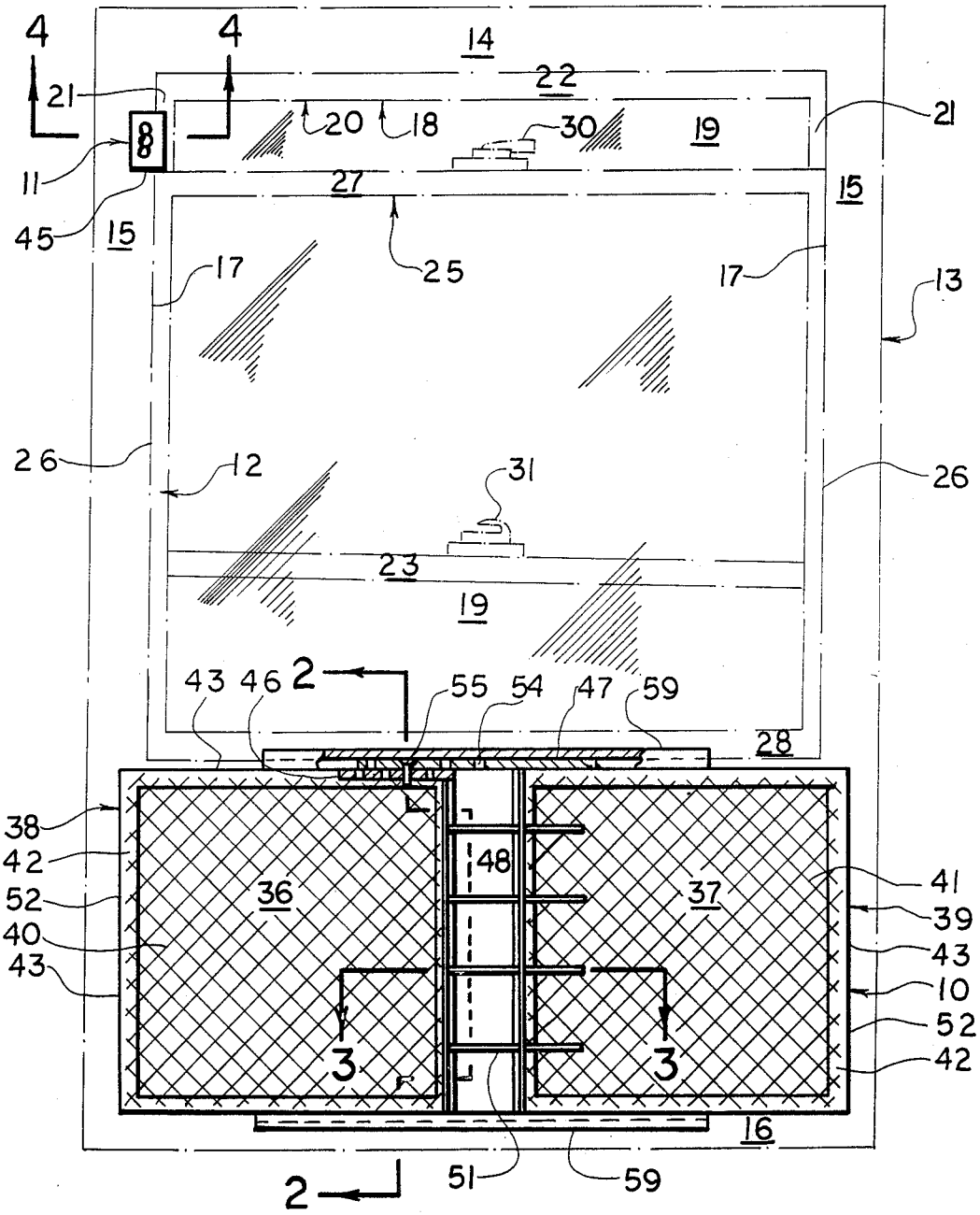
FIG. 1 is a front elevational view of an embodiment of the safeguard system of this invention in operative association with a casement, and window frame fabricated of extruded aluminum stock.
Figure 2:
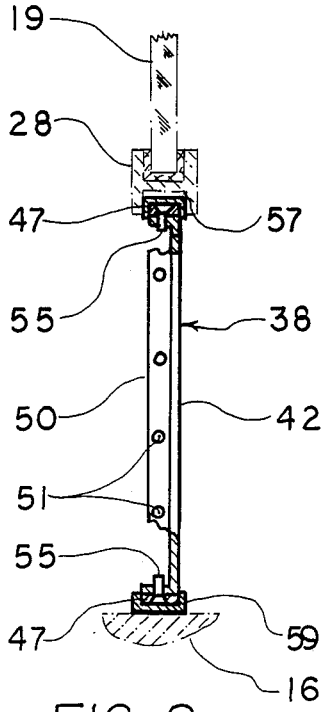
FIG. 2 is a sectional view taken along the line 2—2 of FIG. 1.
Figure 3:
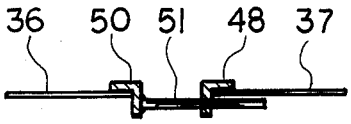
FIG. 3 is a sectional view taken along the line 3—3 of FIG. 1.

Referring to the drawing, a safeguard system of this invention, comprising barrier apparatus 10 and locking means 11, is shown in association with lower interior window 12 slideably mounted within casement 13.

The exemplified casement is constructed of extruded aluminum beams and comprised of top beam 14, side beams 15, and lower beam or sill 16, said beams and sill defining a rectangular space. Associated with the inside faces 17 of side beams 15 are tracks 29 and 32, shown in FIG. 4, which guide the sliding movement of lower interior window 12 and upper exterior window 18, respectively.

Upper window 18 is comprised of transparent panel 19 of glass or plastic such as polyacrylate or polycarbonate material, surrounded by rectangular window frame 20 comprised of vertical members 21, upper horizontal member 22, and lower horizontal member 23.

Lower window 12 is comprised of transparent panel 19 held by frame 25 comprised of vertical members 26, upper horizontal member 27, and lower horizontal member 28.

Conventional securing means in the form of pivoted clasp 30 and interactive holding bracket 31 are positioned atop upper horizontal member 27 and lower horizontal member 23. The arrangement of the two windows within the casement is such that lower window 12 rides in track 29 which is closer to the interior of the building than track 32.

Figure 4:
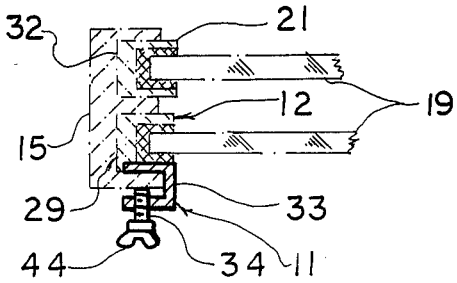
FIG. 4 is an enlarged sectional view taken along the line 4—4 of FIG. 1.
Figure 5:
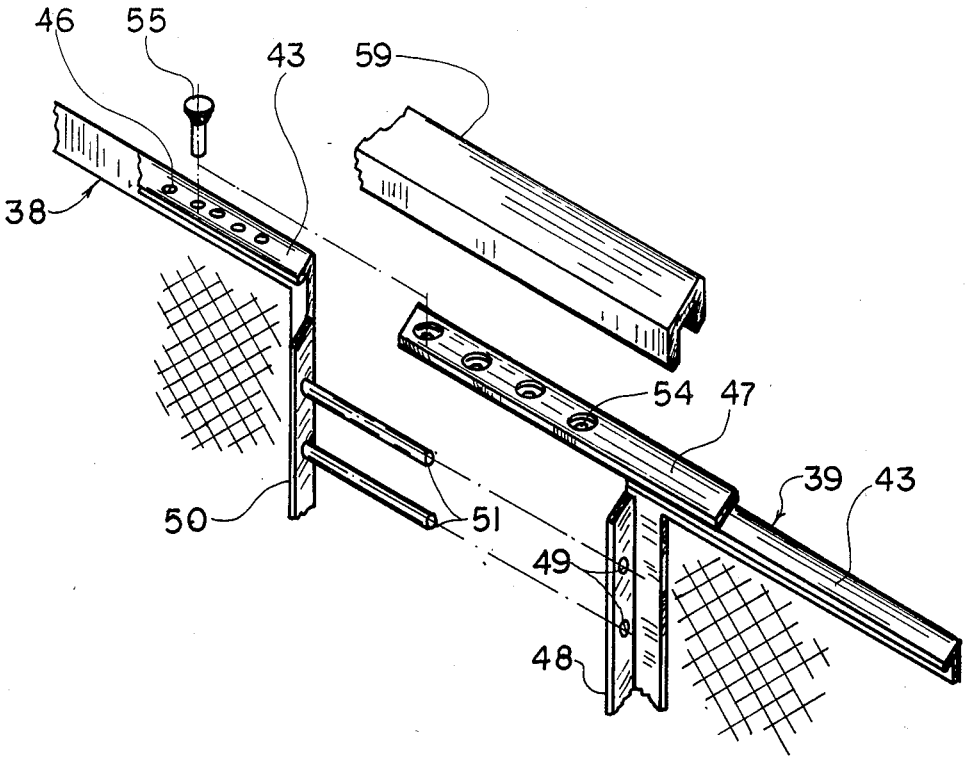
FIG. 5 is an enlarged fragmentary exploded view of a portion of the barrier apparatus shown in FIG. 1.

The exemplified embodiment of locking means 11, as shown more clearly in FIG. 4, is comprised of trough-like bracket 33 of U-cross section, and bolt 34 which threadably engages one arm of the bracket. The opposite arm is adapted to abut an interior vertical surface of track 29 within inside face 17 of side beam 15. A wing head 44 affixed to that extremity of bolt 34 outside of the bracket permits manual tightening of the bolt to anchor the locking means upon side beam 15. Lower extremity 45 of bracket 33 rests in abutment with the upper surface of upper horizontal member 27. It is, however, to be understood that other, equivalent embodiments of locking means may be utilized to immobilize the lower window with respect to the casement.

Barrier apparatus 10 is comprised of a pair of gridwork panels 37 and 36 of substantially identical outer rectangular dimensions welded to first and second frames 39 and 38, respectively. The gridwork panels are comprised of a strong, preferably monolithic array of structural members 40 with intervening spaces 41. The pattern of the array may be of varied design to suit aesthetic preferences. The frames are formed of angle beams of L-shaped cross section, the first shoulder 42 of the beams being parallel to the panel and contiguous thereto to permit welded attachment, the second shoulder 43 of the beams being perpendicular to the panels.

A first series of positioning apertures 46 is provided in the upper horizontal shoulder 43 of frame 38. An extension arm 47 is attached by welding to the upper horizontal shoulder 43 of frame 39. Said extension arm extends horizontally into overlapping relationship with upper horizontal shoulder 43 of frame 38. Said overlapping portion of extension arm 47 is provided with a second series of positioning apertures 54 adapted to align vertically with the apertures of said first series.

A coupling pin 55 having a head adapted to make a substantially flush fit with the upper surface of extension arm 47 is inserted through aligned apertures of said first and second series.

In alternative embodiments of the invention, the extension arm and corresponding series of apertures may be associated with the lower horizontal shoulders of the frames, in which case pin 55 is inserted from below. In still further embodiments, extension arms and associated apertures and pins may be provided at both upper and lower horizontal shoulders.

The inner or facing vertical side border 48 of frame 39 is provided with four guide apertures 49. Inner vertical side border 50 of frame 38 is provided with four horizontally oriented mating posts 51 adapted to insertively penetrate apertures 49 in a telescoping manner. Although the described embodiment of the invention is shown with four mating posts, additional or fewer posts may be used.

The entire barrier apparatus may be fabricated of a weldable grade of steel, and may be provided with a coating capable of thwarting corrosion and providing aesthetic appeal. In use, the two frames are drawn apart horizontally so that the outer vertical side borders of the frames are substantially in contact with side beams 15 or within tracks 29 of the casement. Coupling pin 55 is then inserted into aligned apertures in the extension arm and associated frame, and lower window 12 is brought downwardly so that upper horizontal shoulders 43 are held by downwardly opening groove 57 in lower horizontal member 28. Finally, locking means 11 is fastened appropriately to prevent upward movement of said lower window.

In the illustrated preferred embodiment, channel bars 59 are placed above and below extension arms 47 in a manner to assure retention of coupling pin 55 within the positioning apertures and to further minimize flexural movement between the frames.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A safeguard system for a vertically adjustable window comprising:

(a) a barrier apparatus of adjustable horizontal length adapted for insertion into a window casement below a framed rectangular window slideably positionable within said casement, said barrier apparatus comprising:

(1) two vertically disposed gridwork panels in horizontally spaced coplanar juxtaposition, (2) first and second rigid rectangular frames adapted to border and support said panels, each frame comprising horizontally disposed upper and lower straight borders and facing and outer vertically oriented straight side borders, the facing side border of said first frame having vertically spaced guide apertures, said upper and lower borders being aligned on straight paths, (3) horizontally directed mating posts affixed to the facing side border of said second frame and adapted to slideably penetrate said guide apertures, (4) a first series of positioning apertures of uniform size located in at least one horizontal border, (5) an extension arm associated with the corresponding upper or lower horizontal border of the frame alternate to the frame having said first series of positioning apertures, (6) a second series of positioning apertures located in said extension arm substantially matching the size of the apertures of said first series, and (7) a coupling pin adapted to vertically interengage aligned positioning apertures of said first and second series, thereby fixing the horizontal length of said barrier apparatus, and (b) locking means for immobilizing said slideably positionable window with respect to said casement.

2. The safeguard system of claim 1 wherein said borders of said frames are comprised of rigid metal members having an L-shaped cross section and providing a first shoulder parallel to said panels and a second shoulder perpendicular to said panels.

3. The safeguard system of claim 1 wherein said framed rectangular window is comprised of a lower horizontal frame member, and said casement is comprised of lower horizontal sill member.

4. The safeguard system of claim 3 wherein the lower horizontal frame member of said window is provided with a downwardly opening groove adapted to seat the upper horizontal borders of said frames.

5. The safeguard system of claim 1 further comprising at least one channel bar adapted to fit against said extension arm in a manner to prevent removal of said coupling pin.

* * * * *